US005249620A

United States Patent [19]

Guerriero et al.

[11] Patent Number: 5,249,620

[45] Date of Patent: Oct. 5, 1993

[54] PROCESS FOR PRODUCING COMPOSITE MATERIALS WITH A METAL MATRIX WITH A CONTROLLED CONTENT OF REINFORCER AGENT

[75] Inventors: Renato Guerriero; Ilario Tangerini, both of Mestre, Italy

[73] Assignee: Nuovo Samim S.p.A., Milan, Italy

[21] Appl. No.: 863,497

[22] Filed: Mar. 30, 1992

Related U.S. Application Data

[63] Continuation of Ser. No. 728,020, Jul. 8, 1991, abandoned, which is a continuation of Ser. No. 129,627, Oct. 31, 1989, abandoned.

[30] Foreign Application Priority Data

Nov. 11, 1988 [IT] Italy ..... 2589 A/88

[51] Int. Cl.[5] ..... B22D 19/14; B22D 19/16; B22D 23/00

[52] U.S. Cl. ..... 164/97; 164/101; 164/102; 501/127; 501/95; 501/96; 501/97; 501/80

[58] Field of Search ..... 501/95, 80, 127, 96, 501/97; 164/493, 97, 101, 102; 428/384, 404

[56] References Cited

U.S. PATENT DOCUMENTS

| | | | |
|---|---|---|---|
| 3,770,488 | 11/1973 | Pepper et al. | 428/367 |
| 3,828,839 | 8/1974 | Dhingra | 164/97 |
| 4,214,037 | 7/1980 | Galasso et al. | 428/375 |
| 4,265,981 | 5/1981 | Campbell | 428/365 |
| 4,492,265 | 1/1985 | Donomoto et al. | 164/97 |
| 4,506,721 | 3/1985 | Ban et al. | 164/97 |
| 4,559,246 | 12/1985 | Jones | 164/101 |
| 4,687,043 | 8/1987 | Weiss | 164/102 |
| 4,699,849 | 10/1987 | Das | 428/386 |
| 4,708,104 | 11/1987 | Day et al. | 164/97 |
| 4,828,008 | 5/1989 | White et al. | 164/97 |

FOREIGN PATENT DOCUMENTS

| | | | |
|---|---|---|---|
| 0064833 | 4/1984 | Japan | 164/101 |
| 0101271 | 6/1984 | Japan | 164/101 |

*Primary Examiner*—Mark L. Bell
*Assistant Examiner*—Paul Marcantoni
*Attorney, Agent, or Firm*—Morgan & Finnegan

[57] ABSTRACT

A process for producing composite materials with a metal matrix and with a content of powder reinforcer agent lower than is minimum theoretical compaction value, with said process being based on an infiltration technique, is disclosed, which essentially consists in charging the reinforcer material to a casting mould, and then infiltrating into the same mould the metal matrix in the molten state, with said metal matrix being let cool until it solidifies, and characterized in that the reinforcer agent, consisting of non-metal powders, is blended, before being charged to said casting mould, with a diluting agent having a different compaction degree, constituted by metal fibres and/or ceramic fibres and/or ceramic whiskers and/or metal powders of the same composition as of the matrix.

6 Claims, No Drawings

PROCESS FOR PRODUCING COMPOSITE MATERIALS WITH A METAL MATRIX WITH A CONTROLLED CONTENT OF REINFORCER AGENT

This is a continuation of co-pending application Ser. No. 07/728,020, filed on Jul. 8, 1991, now abandoned, which is a continuation of co-pending application Ser. No. 07/429,627, filed on Oct. 31, 1989, now abandoned.

The present invention relates to a process for producing composite materials based on a metal matrix, and with a controlled content of reinforcer agent.

Composite materials are combinations of two or more materials existing in distinct phases, suitable for forming predetermined structures showing more advantageous characteristics than of each component.

As compared to those of homogeneous materials, the characteristics of composite materials show improved values as regards their physical properties, mechanical properties and so forth.

A composite material is constituted by a phase (e.g., a metal phase) which surrounds and bonds the other phases (e.g., of ceramic fibres or powders).

In case of metal-matrix composites, endowed with structural characteristics, the relative roles played by the matrix and by the reinforcer phase are the following:

the reinforcer agent has high values of strength and hardness, and the matrix transfers to it the stresses it is submitted to;

the matrix has good inherent characteristics (physical characteristics, chemical characteristics. and so forth), and the reinforcer agent serves to endow the material with particularly good mechanical properties.

Some properties of the composites can be computed with exactness by predetermining the volumetric percentages and the characteristics of their component phases; other properties can be computed on approximate models; and other properties can be forecast with difficulty, such as, e.g., fracture strength, which, although is easy determined, is always difficult to be estimated in advance.

The composites can be anisotropic; for example, a composite reinforced with long fibres shows a much higher strength in the direction parallel to the fibres, than in the transversal direction thereof; therefore, the designer will take this matter of fact into due account in order to secure a high strength in the desired direction.

Inasmuch as the reinforcer agent is used in order to improve the mechanical properties of a given matrix, it should be endowed with well determined requisites, such as, e.g., high values of mechanical strength and of elastic modulus.

These reinforcer materials are in the form of long-fibre or short-fibre filaments, or in the form of powders; for example, whiskers are monocrystalline filaments of a few microns of diameter and of some hundreds of microns of Length, endowed with high mechanical properties; they make it possible composites with high characteristics to be obtained. Unfortunately, their costs are still now too high. Silicon carbide whiskers are among those with highest values of tensile strength and of elastic modulus.

The reinforcer agents are usually classified as:

metal fibres: W, W+SiC, W+$B_4C$, Be, steel;

Long or short ceramic fibres: $Al_2O_3$, SiC, C, BN, $SiO_2$, glass;

ceramic whiskers: SiC, $Si_3N_4$, $B_4C$, $Al_2O_3$;

powders: SiC, BN, $Si_3N_4$, $B_4C$, $SiO_2$, $Al_2O_3$, glass, graphite.

As regards the matrices, one might say that many materials can constitute a matrix: metals and ceramic materials can be mentioned for composites destined to operate at medium-high temperatures; at relatively low temperatures, also a very Large number of thermosetting and thermoplastic resins can be advantageously used.

As compared to resins, metals are affected by some disadvantages in terms of weight, anyway compensated for by the high values of their mechanical properties at higher temperatures, as well as by sometimes favourable characteristics of electrical and heat conductivity.

The economic attractions for a particular matrix to be used increase in case the reinforcer agent expands its application field.

The methods of preparation known from the prior art depend on the type of metal matrix used; anyway, Limiting ourselves to the most diffused matrix, i.e., Al or its alloys, we may describe them as follows:

Method of Reinforcer Agent Dispersion

This method consists in adding short fibres or whiskers or reinforcer particles to a metal bath kept in the molten state, with strong stirring and under an inert blanketing atmosphere. The step of casting or extrusion is subsequently carried out. A preliminary treatment should be usually carried out on the reinforcer agents in order to secure the wettability thereof by the matrix.

Method of Dispersion of the Reinforcer Agent on a Partially Solid Matrix

This method consists in dispersing the reinforcer agent into the semisolid metal matrix, with stirring. Said semisolid metal matrix is obtained by submitting the alloy to shear stresses during the step of cooling from a molten mass, so that it is in a semiliquid condition even when its content of solid matter exceeds 50%. The semisolid composite is subsequently cast.

Method of Powder Metallurgy

This method consists in cold compacting blends of powders of matrix material and of reinforcer material, and in subsequently submitting them to hot-pressing. The pieces can be then submitted to mechanical processings, to lamination or to extrusion. Composites with reinforcer fibres can be obtained as well, if a suitable system of pre-impregnation of green premoulded pieces of the fibre with matrix powder suspensions is used.

Method of Fibre Metallization

This method consists of pre-coating the fibres with metals, by means of a molten metal bath, or by plasma-spraying or electrolytic methods.

In order to obtain the composite, the fibres are then hot-compacted at high enough temperatures for the metal Layer to fill all of the cavities.

Method of Layer Compaction

This method consists in alternating layers of fibres with layers of matrix in the form of sheets. The subsequent hot-pressing under vacuum will enable the metal to flow through the fibres, with a homogeneous distribution of same fibres in the end composite being obtained.

Infiltration Method

This method consists in causing a molten alloy of Al to flow, under an increased pressure (comprised within the range of from 10 to 30 MPa), through a preformed green piece, or a suitable pattern of powders and fibres contained inside a mould.

The time of solidification of the alloy, after the occurred infiltration, is such as to minimize the phenomena of chemical reaction between the matrix and the reinforcer agent.

Inasmuch as the minimum compaction value of a given reinforcer powder is already per se high (about 50% by volume), the problems arise of being able to obtain by infiltration composites containing a powder percentage lower than the above said value and of being able to secure a predetermined and reproducible content.

The present Applicant found now a process by infiltration which overcomes the hindrances determined by the infiltration processes known from the prior art.

The process according to the present invention for producing composite materials with a metal matrix and with a content of reinforcer agent lower than its minimum theoretical compaction value, with said process being based on an infiltration technique, essentially consisting in charging the reinforcer material to a casting mould, and then infiltrating into the same casting mould the metal matrix in the molten state, with said metal matrix being then let cool until it solidifies, is characterized in that the reinforcer agent is mixed, before being charged to said casting mould, with a diluting agent having a different compaction degree.

The metal matrices of said composite materials are selected from among Pb, Zn, Al, Mg, Cu, Sn, In, Ag, Au or their alloys.

The reinforcer agent is constituted by non-metal powders.

The diluting agent is selected from among metal fibres and/or ceramic fibres and/or ceramic whiskers and/or metal powders of the same composition as of the matrix.

As ceramic fibres, the following fibres can be used: $Al_2O_3$, SiC, C, BN, $SiO_2$, glass:

As ceramic whiskers, the following can be used: SiC, $Si_3N_4$, $B_4C$, $Al_2O_3$;

As non-metal powders, the following can be used: SiC, BN, $Si_3N_4$, $B_4C$, $SiO_2$, $Al_2O_3$, glass, graphite.

As metal fibres, the following can be used: Be, W, W coated with SiC, W coated with $B_4C$, steel.

The blending of the reinforcer agent and of the diluting agent is carried out in such a way as to obtain green premoulded pieces which are then charged to the casting mould.

By means of the term "green premoulded pieces" pieces are meant, which have a porous structure with a suitable and predetermined shape, such as, e.g., sheets, bars, disks, rings, tubes, elbows, and so forth, to be subsequently charged to the casting moulds in order to either totally or partially reinforce a metal casting.

Some examples are now given for the purpose of better illustrating the invention, which examples should not be construed as being in any way limitative of the same invention.

EXAMPLES 1-5

By blending heterogeneous reinforcer agents and subsequently charging them to a casting mould and then infiltrating them with a molten metal matrix, composite materials are obtained after solidification, which contain less than 50% by volume of reinforcer agents.

The resulting products are the following:

1) 20% by volume of SiC powder+20% by volume of short fibre of $Al_2O_3$; infiltrate; Zn-Al alloy at 27% by weight of Al.

2) 30% by volume of SiC powder +10% by volume of short fibre of $Al_2O_3$; infiltrate: An-Al alloy at 27% by weight of Al.

3) 10% by volume of SiC powder+20% by volume of short fibre of $Al_2O_3$; infiltrate: Zn-Al alloy at 27% by weight of Al.

4) 20% by volume of SiC powder+20% by volume of short fibre of $Al_2O_3$; infiltrate: lead.

5) 20% by volume of SiC powder+20% by volume of fiberglass; infiltrate: lead.

EXAMPLES 6-9

By blending a reinforcer agent in powder form and a metal powder, and subsequently charging them to a casting mould and then infiltrating them with a molten metal matrix of the same composition as of the above said metal powder, composite materials are obtained after solidification, which contain less than 50% by volume of reinforcer agents.

The resulting products are the following:

6) 25% by volume of SiC powder+ 25% by volume of Lead powder; infiltrate: Lead 7) 20% by volume of SiC powder+30% by volume of Lead powder; infiltrate: Lead 8) 40% by volume of SiC powder+10% by volume of ZN-Al alloy powder (at 27% by weight of Al) infiltrate: ZN-Al alloy at 27% by weight of Al.

9) 30% by volume of SiC powder+20% by volume of Zn-Al alloy powder (at 11% by weight of Al); infiltrate: Zn-Al alloy at 11% by weight of Al.

EXAMPLES 10-14

By blending heterogeneous reinforcer agents so as to obtain green premoulded pieces which are subsequently charged to a casting mould and then infiltrating them with a molten metal matrix, composite materials are obtained after solidification, which contain less than 50% by volume of reinforcer agents.

The resulting products have the same content of reinforcer agent, as % by volume, as of the composites of Examples 1-5, i.e.:

10) 20% by volume of SiC powder+20% by volume of short fibre of $Al_2O_3$; infiltrate: Zn-Al alloy at 27% by weight of Al.

11) 30% by volume of SiC powder+10% by volume of short fibre of $Al_2O_3$; infiltrate: Zn-Al alloy at 27% by weight of Al.

12) 10% by volume of SiC powder+20% by volume of short fibre of $Al_2O_3$; infiltrate: Zn-Al alloy at 27% by weight of Al.

13) 20% by volume of SiC powder+20% by volume of short fibre of $Al_2O_3$; infiltrate: lead.

14) 20% by volume of SiC powder+20% by volume of fiberglass; infiltrate: Lead.

EXAMPLES 15-17 (COMPARATIVE EXAMPLES)

By filling the casting mould with a homogeneous reinforcer agent in powder form and subsequently infiltrating it with a molten metal matrix of the same composition as of the above said metal powder, composite materials are obtained after solidification, which contain about 50% by volume of reinforcer agent.

The resulting products are the following:

15) about 50% by volume of SiC powder; infiltrate: lead 16) about 50% by volume of SiC powder; infiltrate: Zn-Al alloy at 27% by weight of Al.

17) about 50% by volume of SiC powder; infiltrate: Pb-Ag alloy at 0.75% by weight of Ag.

We claim:

1. Process for producing a composite material from a metal matrix and a SiC or SiC and $Al_2O_3$ reinforcer agent wherein said composite material has a content of 10% to 50% by volume reinforcer agent wherein said content is lower than the minimum compaction value of said reinforcer agent comprising the steps of:

(1) mixing the reinforcing agent consisting of non-metal powders with a diluent agent of metal fibres, ceramic fibres, ceramic whiskers or metal powders said diluent agent having a different degree of compaction then said reinforcing agent;

(2) charging the reinforcer material to a casting mould;

(3) infiltrating into the same mould the metal matrix in a molten state; and (4) allowing the metal matrix to then cool until it solidifies.

2. Process according to claim 1, wherein the metal matrix is selected from the group consisting of Pb, Zn, Al, Mg, Cu, Sn, In, Ag, Au and their alloys.

3. Process according to claim 1, wherein the ceramic fibres are selected from among $Al_2O_3$, SiC, C, BN, $SiO_2$ and glass.

4. Process according to claim 1, wherein the ceramic whiskers are selected from among SiC, $Si_3N_4$, $B_4C$ and $Al_2O_3$.

5. Process according to claim 1, wherein the non-metal powders are selected from among SiC, BN, $Si_3N_4$, $B_4C$, $SiO_2$, $Al_2O_3$, glass and graphite.

6. Process according to claim 1, wherein the metal fibres are selected from among Be, W, W coated with SiC, W coated with $B_4C$, and steel.

* * * * *

UNITED STATES PATENT AND TRADEMARK OFFICE

CERTIFICATE OF CORRECTION

PATENT NO. : 5,249,620

DATED : October 05, 1993

INVENTOR(S) : Renato Guerriero, et al.

It is certified that an error(s) appears in the above-identified patent and that said Letters Patent is hereby corrected as shown below:

Cover page, left hand column in Related U.S. Application Data, line 2, change "129,627" to --429,627--.

Signed and Sealed this

Thirty-first Day of May, 1994

Bruce Lehman

*Attest:*

BRUCE LEHMAN

*Attesting Officer*

*Commissioner of Patents and Trademarks*